United States Patent [19]

Skipper

[11] Patent Number: 4,893,675

[45] Date of Patent: Jan. 16, 1990

[54] SECTION MILLING TOOL

[76] Inventor: Uvon Skipper, 7409 S. Rice Ave., Bellaire, Tex. 77401

[21] Appl. No.: 273,906

[22] Filed: Nov. 21, 1988

[51] Int. Cl.[4] ..... E21B 29/00

[52] U.S. Cl. ..... 166/55.8; 175/269; 30/106

[58] Field of Search ..... 166/55.6, 55.7, 55.8, 166/297, 298, 376, 55, 55.1, 55.2, 55.3; 175/267, 269; 30/105, 106

[56] References Cited

U.S. PATENT DOCUMENTS

| | | | |
|---|---|---|---|
| 2,353,284 | 7/1944 | Barrett | 166/55.8 |
| 2,481,637 | 9/1949 | Yancey | 166/55.8 |
| 3,083,765 | 4/1963 | Kammerer | 166/55.8 |
| 3,316,970 | 5/1967 | Huitt et al. | 166/55.7 |
| 4,614,242 | 9/1986 | Rives | 175/269 |

*Primary Examiner*—Jerome W. Massie, IV
*Assistant Examiner*—Terry Lee Melius
*Attorney, Agent, or Firm*—Gunn, Lee & Miller

[57] ABSTRACT

A milling machine is set forth for operation on a pipe string in a cased well to mill the casing. In one embodiment, an inner mandrel having a shoulder is aligned relative to a set of first cutters which are retracted. They are radially extended through slots in an outer body for cutting operations when the pipe string is rotated. Extension is acccomplished by raising pump pressure to move an inner mandrel having a shoulder juxtapositioned relative to the cutters. In an alternate embodiment, the inner mandrel has two shoulders which cooperate with two separate sets of cutters wherein the first set is fully extended and the second set in only partially extended. The coil spring controlling the shoulder for the second set of cutters. The lower end of the tool body includes a constricted outlet orifice for mud flow and an alternate pathway through the inner mandrel and outer body is provided to flush cuttings and chips from the cutters.

13 Claims, 4 Drawing Sheets

FIG. 5
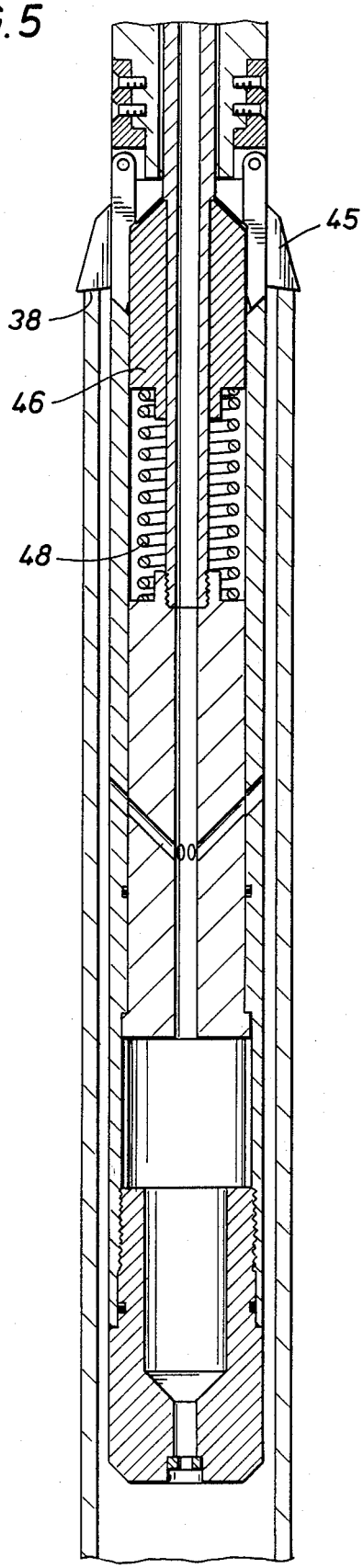
FIG. 6
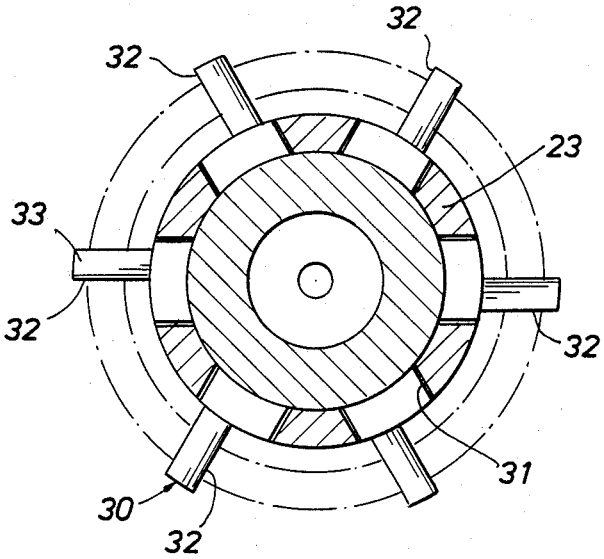
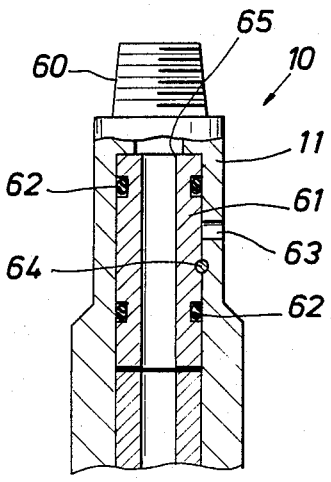
FIG. 7

SECTION MILLING TOOL

BACKGROUND OF THE INVENTION

It is necessary in remedial work in a cased oil well to mill out a portion of the casing that was previously cemented in the well. For example, when repairing a section of the pre-existing casing must be milled out. Milling tools are believed well known. The present disclosure is directed to an improved milling machine which is initiated in operation by an increase in mud pressure when installed on a drill string in a casing. It is constructed with an internal telescoping mandrel responsive to the increase in pressure. The pressure moves the mandrel relatively upward in the tool against a compressible coil spring, thereby setting the tool. Setting is accomplished by deflecting outwardly a set of pivotal cutting blades. They are jointly retracted radially inwardly until mandrel movement whereupon they move jointly outwardly. Outward movement is constrained by the surrounding casing; as the tool is rotated, the cutting blades cut into the surrounding casing, and ultimately penetrate the casing. As this occurs, further movement upwardly holds the cutters in the outwardly extended position. they are locked outwardly by the further movement of the internal mandrel. The tool is then lowered continuously during milling until a sufficient length of the casing has been milled away.

It may be necessary to mill away more casing than the cutters can tolerate. As this occurs, it is ordinarily necessary to retrieve the string of drill pipe, remove the milling tool and replace it with a new milling tool or at least replace the worn cutters with new cutters. Thereafter, it would be necessary to reposition the equipment previously in the casing at the depth where the previous milling job had been partially completed so that the next milling cut could then be continued. If the pipe string has to be pulled and then placed back in the well, substantial rig time is involved at a significant cost. Moreover, there is always the problem of relocating the bottom shoulder of the cut portion of the casing so that the next milling cut proceeds previously below the prior milling cut. Another problem relates to the burs left after cutting; they may puncture packers inserted later. By contrast, the present apparatus is a system wherein first and second or additional sets of cutters are installed on a common mechanism. The first set of cutters is retracted adjacent a mandrel to be deflected outwardly as described above. The same mandrel positions the second set of cutting blades which are not extended fully radially outwardly while the first set is extended. The first set of blades is thus used to make the first milling cut; when those blades wear away and milling progress becomes unacceptably slow, the pipe string is lifted slightly to move the second set of cutters upwardly until they are positioned adjacent the shoulder of the cut portion at which occasion the second cutters are free to deflect radially outwardly into the cutting position. The second set is the operative and is able to complete the milling without requiring intermediate retrieval of the pipe string. The multiple sets of cutters can be designed differently so that the first set of cutters simply cuts through the casing while the last set of cutters forms a chamfered shoulder and removes burs.

While the foregoing has spoken generally of at least one important advantage of the present apparatus, the detailed description of the milling tool is set forth below in conjunction with the drawings of the two preferred embodiments.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

Figure 1:
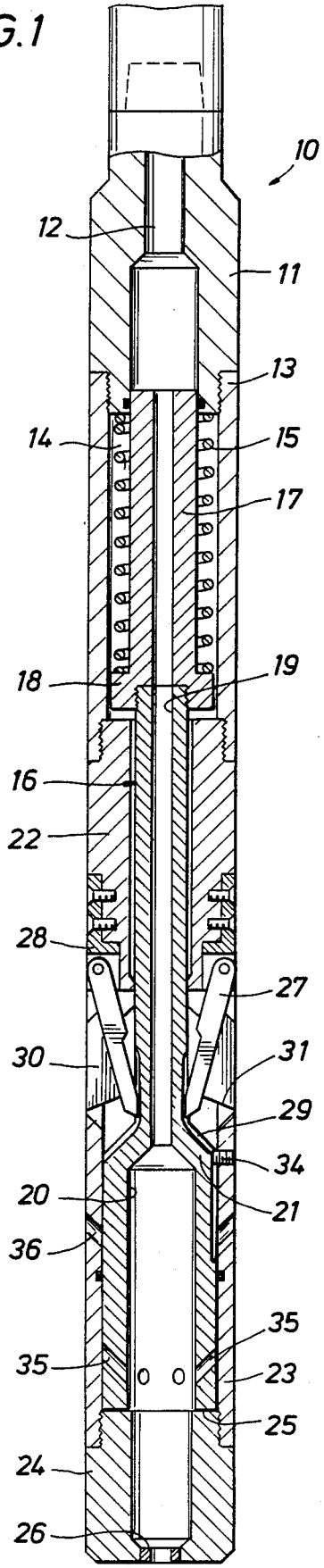
Figure 2:
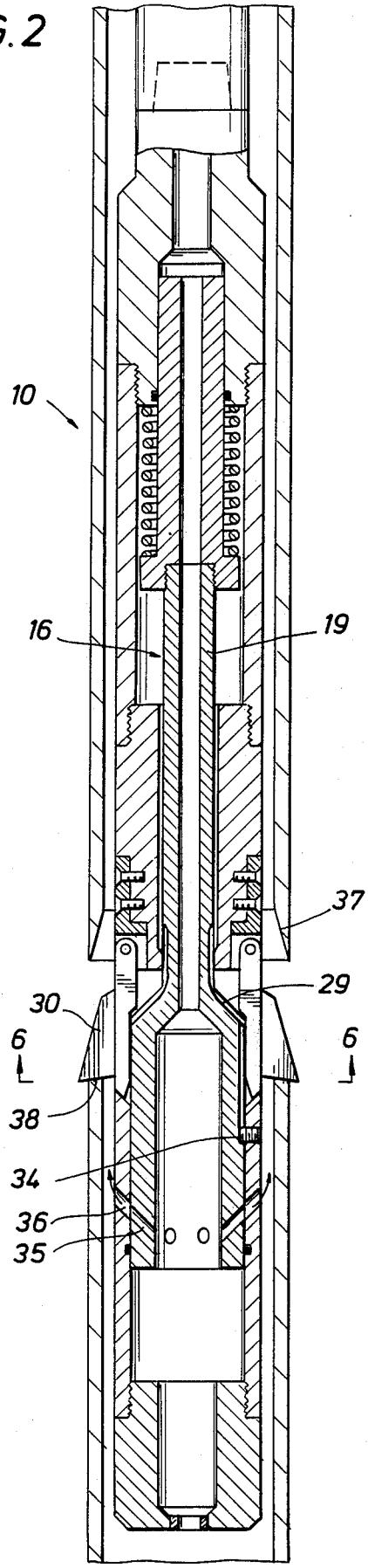
Figure 3A:
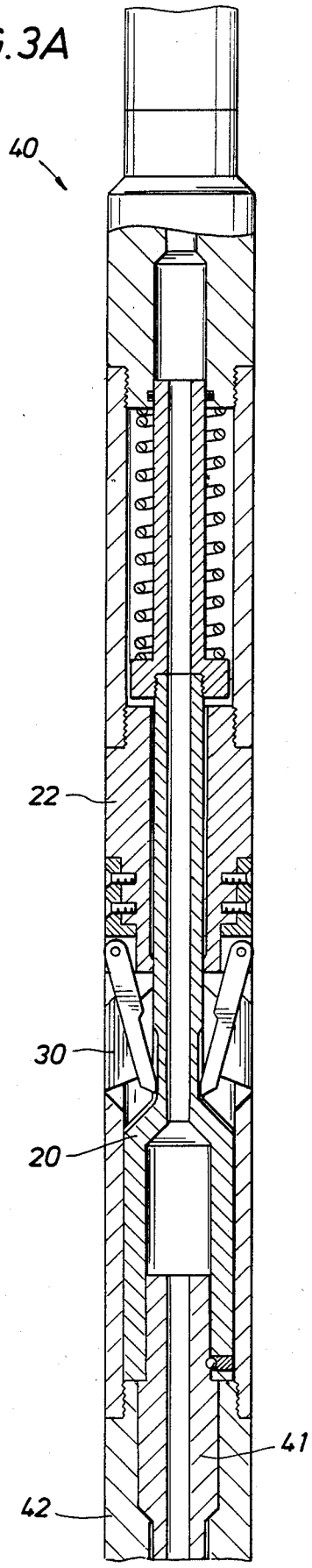
Figure 3B:
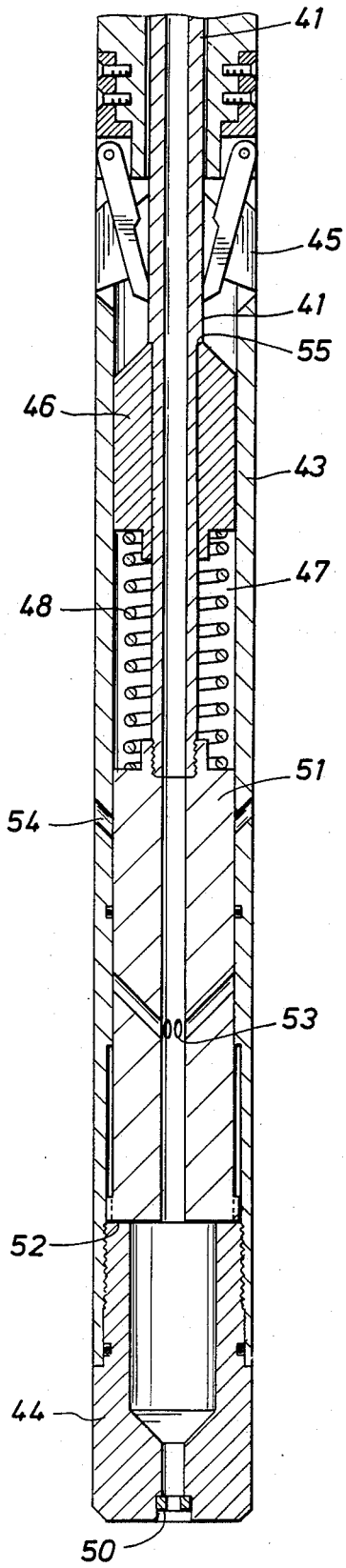
Figure 4A:
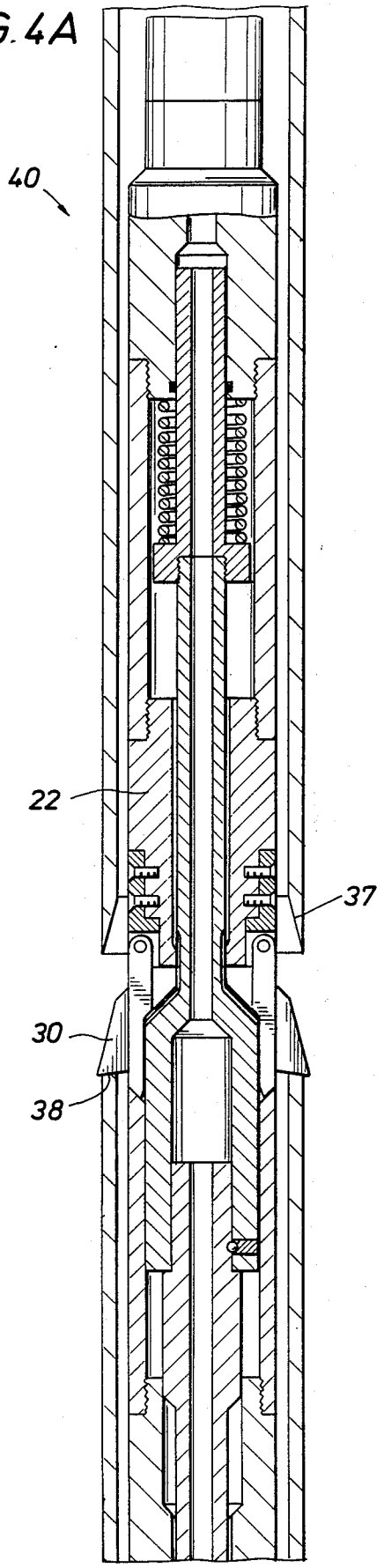
Figure 4B:
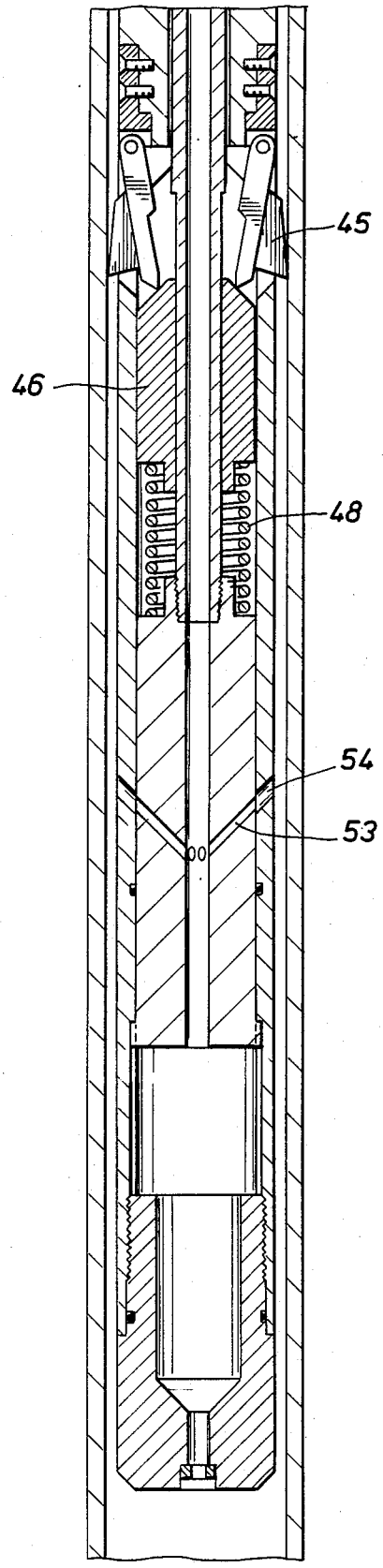

IN THE DRAWINGS;

FIG. 1 is a lengthwise sectional view along the center line of a milling tool in accordance with the present disclosure illustrating the tool in the retracted position so that it can be run into a casing for subsequent milling operations;

FIG. 2 shows the milling tool of FIG. 1 in a casing with the cutters extended for milling the casing with rotation and downward travel;

FIGS. 3A and 3B serially describe an alternate embodiment having two or more sets of cutting blades to perform a longer cut;

FIGS. 4A and 4B jointly show the milling tool having two sets of cutters where the first set of cutters is extended into the casing and the second set of cutters is positioned partly extended prior to axial movement of the cutting tool to enable full extension thereof;

FIG. 5 is a view of the lower portions of the tool shown in FIG. 4B wherein the second set of cutters extended for milling the casing;

FIG. 6 is a sectional view along the line 6—6 of FIG. 2 showing mounting of the cutters so they have cutting edges on radial lines of the apparatus; and FIG. 7 is a sectional view of the top end of the tool showing a ball operated retracting mechanism.

DETAILED DESCRIPTION OF THE FIRST EMBODIMENT

In FIG. 1 of the drawings, the numeral 10 identifies a milling machine having one set of cutters. It will be described in detail and its operation will be set forth also. Thereafter, the alternate embodiment shown in FIG. 3 will be described in detail.

The embodiment 10 incorporates a threaded upper sub 11 which is adapted to be threaded into and placed in communication with a pipe string to be run into a casing for milling purposes. there is an axial bore at 12 so that drilling fluid can flow through the tool. The sub 11 is threaded to an external sleeve 13 which defines an internal annular space 14, and a coil spring 15 is placed in that space. The spring bears against the sub 11 at the upper end. The spring surrounds a mandrel 16 which is made of multiple parts. The upper end of the mandrel is formed by the hollow rod 17. It is constructed with a lower surrounding shoulder 18 which abuts the coil spring 15 to compress the spring. The annular space 14 is sufficiently large to receive the peripheral shoulder 18. The mandrel 16 is also comprised of an elongate extension 19 which threads to the rod 17. The extension 19 extends downwardly to an enlarged portion 20, the enlarged portion 20 having an external tapered shoulder 21 for purposes to be described. The shoulder 21 is on the exterior of the enlargement and cooperates with the cutting knives as will be set forth. Moreover, the enlargement 20 is hollow to continue the axial flow path to the lower end of the tool 10.

The mandrel 16 telescopes inside of the surrounding structure. The surrounding structure comprises the sub 11 and the external threaded sleeve 13. The sleeve 13 is threaded to the body 22. The body 22 is a solid body having a number of slots or grooves cut in it, and extends further downwardly at the surrounding skirt 23 and then threads to the tail piece 24. The tail piece includes an internal upwardly facing shoulder 25 for limiting downward travel of the inner mandrel. The tail piece also includes a bottom outlet 26 for mud flow. The outlet 26 is a constricted opening having a removable and replaceable insert so that the size of the opening can be limited for reasons to be described.

The body 22 has several lengthwise windows formed in it, there being individual windows for individual cutters. Each cutter is formed of a pivoted arm 27 which is connected to a mounting block 28. The mounting block is attached or affixed by means of suitable bolts which thread into the body 22. The mount 29 terminates at a clevis supporting the arm 27. The arm can deflect through an angle as illustrated in contrasting FIGS. 1 and 2. The shoulder 21 is grooved with guide slots 29 to prevent deflection laterally of the arm 27. The arm tips 29 ride in the slots so that the arms 27 are constrained against bending. On movement, the arms each move a cutter 30 into a milling position where the cutter extends through an appropriately located slot 31 formed in the surrounding skirt 23. The arm 27 is pivotally mounted and has a tip end adjacent to the shoulder 21 on the enlargement 20 in the slot 29. Because of the angle between the arm and the shoulder, upward movement of the enlargement forces the arm to rotate radially outwardly so that the cutter 30 is forced out of the slotted window for that particular cutter. In FIG. 6 of the drawings, the windows 31 are shown arranged so that the respective cutters 30 may extend outwardly into cutting position for milling the casing. Moreover, each cutter is offset so that it has a cutting face 32 which is arranged on a radial line through the center line axis of the rotating equipment. Cutting occurs at the face 32 as well as the bottom face 33. The faces 32 are all located on radial from the center line.

Operation of the milling tool 10 is described in contrasting FIG. 2 with FIG. 1. Fluid pressure is raised, and is raised sufficiently that the constriction at 26 creates a backpressure thereabove. This forces the enlargement 20 to move upwardly which moves the entire inner mandrel. When it moves upwardly, the spring 15 is compressed. After the inner mandrel moves up a specified distance, alignment is accomplished with a set of passages to thereby divert substantial flow into the annular space around the miller 10. The enlargement 20 incorporates a number of ports 35 with lateral passages formed therethrough. The ports 35 direct mud flow through the wall of the enlargement 20. The ports 35 direct fluid flow through the passages 36 in the skirt 23. This relieves the mud flow route through the constriction 26 and directs a substantial portion of the mud flow to the annular space on the exterior of the miller 20. This directs the mud flow up past the various cutters to provide a flushing action away from the region of cutting so that the chips that are milled from the casing are carried upwardly in the annular space and are recovered in the mud stream. Two alignment feature should be noted. A set screw 34 protruding into a slot aligns the inner mandrel to prevent relative mandrel rotation. The screw is also a limit or travel stop. The mandrel within the body 22 is sized so the annular space 14 drains along the mandrel.

In operation as shown in FIG. 2, pump pressure is raised so that the cutters 30 are forced outwardly. On their first move outwardly to the extent where they extend through the slots 31, they are constrained by the surrounding casing. With rotation in the proper direction, cutting action begins. As the cutting continues, the casing is then cut so that the cutters can extend further outwardly. Finally, the cutters mill through the casing. This typically will be evidenced by a change in torque on the pipe string used to rotate the miller 10. When this occurs, the cutters are fully radially extended as depicted in FIG. 2. They form the shoulder 37 in the upper portion of the casing. With the change in torque as evidence, the next step is to continue rotation and begin advancing the miller 10 downwardly. This begins the cutting action at the shoulder 38 on the casing so that milling continues, and the downward travel simply mills away the casing during downward movement. Downward travel is continued to mill away a specified length of the casing. The cutters actually extend through the casing when the casing is fully penetrated and mill away a portion of the cement surrounding the casing. If the casing incorporates a coupling, that also will be cut away. Cutting continues as the window formed in the casing is enlarged until the requisite length of window is finished. At that juncture, pump pressure is simply reduced and the coil spring 15 forces the inner mandrel downwardly, enabling retraction of the cutters. Then, the miller 10 can be retrieved. Alternately, milling can continue until the cutters are completely worn away. If that occurs, the tool can again be retrieved after reduction of pressure whereupon the cutters are again retracted for easy retrieval. By observation of pump pressure and torque required during rotation and advancement, the start and length of the milling cut can then be determined at the well head.

DESCRIPTION OF THE DUAL CUTTER MILLING TOOL IN FIG. 3

The embodiment 40 is FIG. 3 shows a miller which is similar to that shown in FIG. 1 but which includes two or more sets of cutters. Common components have been assigned the same reference numerals as used in FIG. 1. The dual cutter miller 40 thus incorporates identical reference numbers in FIG. 3A. FIG. 3A shown the enlargement 20 joined to a mandrel extension 41 which is received within an external threaded sub 42 which is joined to the skirt 23 by a set of threads. In contrasting FIG. 3A with FIG. 4A, the inner mandrel 16 moves upwardly and carries the mandrel extension 41 with it. The outer sub 42 supports a set of cutters which are constructed identically to those shown in FIG. 1 and indicated at the numeral 30. Accordingly, the second cutters in FIG. 3B will be identified at 45 and they are similar to or different from the cutters 30 previously described. The cutters 45 will be described generally as the milling cutters. The first cutters can cut casing away to define a window of specified length. The second cutters can be identical to extend the window for a greater length. The last cutters usually are different so that they cut a chamfer on the shoulder 38 to remove burs and smooth the cut area. The second cutters 45 may debur while extending the window. The dual cutter miller 40 thus utilizes the second cutters 45 which are located at a specified length along the tool body below the first cutters 30. In FIG. 3B, the mandrel extension 41 supports a sleeve 46 on the exterior of the mandrel. The sleeve abuts a spring 48 which is located in an annular space 47 around the inner mandrel 41. The sub 42 is similar to the sub 22 thereabove and has an appended lower skirt 43 which is similar to the skirt 23 shown in FIG. 1. The skirt 43 is fairly long, however, and terminates at a bottom sub 44, similar to the sub 24 shown in FIG. 1. It is in like fashion closed with an internal replaceable orifice 50 which constricts fluid flow. The mandrel extension 41 terminates by threading into an enlargement 51. The enlargement 51 abuts against the shoulder 52 shown in FIG. 3B which limits downward motion. The enlargement has a set of ports at 53 which direct mud flow radially outwardly and upwardly when aligned with the ports 54 in the skirt 43. As shown in FIG. 3B they are offset, but axial alignment of the components brings the parts and passages into alignment so that fluid flow is directed radially outwardly. The sleeve 46 is free to move on the mandrel extension 41. It is caught at an upper shoulder 55 but is able to move downwardly against the coil spring 48.

Attention is directed to the contrast of FIG. 3 with FIG. 4 to show operation of the present apparatus 40. In FIG. 4, the miller 40 (having multiple sets of cutters) is shown in position for forming an extended milling cut in a casing. The cutters 30 are shown extended forming the first milling cut. This is accomplished as the miller is rotated and lowered at a controlled rate to force the cutters 30 against the shoulder 38 as the casing is milled away. In other words, the first step involves cutting with the first cutters 30. The milling cutters 45 are only partly extended. While this occurs, the second cutters 45 extend only partly outwardly. The sleeve 46 is forced downwardly because the arms supporting the cutters can not deflect fully outwardly. This compresses the spring 48. This in contrasting FIG. 3B with 4B, it will be observed that the spring 48 compresses, continuously urging the cutters 45 outwardly but they are constrained by the surrounding casing. The spring 48 bears on the cutters 45 but permits the cutters 45 to deflect only partly outwardly as exemplified at FIG. 4B. Operation of the miller 40 should be considered. It is set in the same fashion. This is, the mud pump pressure is raised, thereby forcing the inner mandrel upwardly. With rotation, the cutters 30 penetrate the casing, forming the upper cut shoulder at 37 and starting the cut 38 as the tool is lowered. In summary, the two (or more) sets of cutters are operative in different ways. The first set must cut through the casing and cut the shoulder to form the window. The second set must cut after the first set, and as desired, it is equipped to cut a chamfer.

The cutting sequence is the same as previously given for the embodiment 10. The cutters 30 are used to cut away the casing until the cutters 30 wear out. This may involve several hours of milling. In any event, assume that it is necessary to remove about 20 feet of the casing. Assume further that the cutters 30 are estimated to be capable of milling about 10 to 12 feet of the casing before wearing out. In this example, the first cutters 30 are operated as shown in FIG. 4A to mill the casing until 10 feet of the casing has been removed. By observation of the rate of advance of the miller 40 in conjunction with the torque required to rotate the pipe string connected to the miller, wear of the cutters 30 can be estimated at the surface. In the foregoing example, the torque and rate of advance of the pipe string are observed while the cutters 30 operate. Eventually, the torque will increase and the rate of advance will decrease, indicating that the cutters 30 are wearing away and are no longer able to complete the milling operation. When the cutting operation has continued until the cutters 30 are deemed to be sufficiently worn, the pipe string is then momentarily raised. It is raised by something slightly more than the spacing between the cutters 30 and 45. If that spacing is two feet, the pipe string might be raised perhaps three feet to assure that the cutters 45 are raised in the casing by such distance that enables the cutters 45 to be set free of the constraint of the surrounding casing. This contrast is best shown in FIGS. 4B and 5. Even though the cutters 45 are initially constrained, upward movement of the cutters 45 with the miller 40 brings the cutters 45 even with the portion of casing previously milled away so that they are no longer constrained. If the spacing is two feet and the miller 40 is raised by three feet, then the cutters 45 should project outwardly (shown in FIG. 5) above the casing so that the miller 40 can then be lowered by one foot to bring the cutters 45 into contact with the casing at the shoulder 38, all as exemplified at FIG. 5. The milling process is then restarted by rotation. In fact, when rotation is stopped, contact of the cutters 45 against the shoulder 38 can be later determined simply by lowering the pipe string so that the cutters 45 sit on the shoulder 38. This will normally assist the verification that the cutters 45 are at the right location along the casing.

One of the benefits of the foregoing procedure is that the cutters can be switched from a worn set to a unused set, bearing against the casing, all without retrieval of the pipe string. Rather, upward travel of just a few feet is required, that is, travel sufficient to clear the cutters above the casing shoulder 38. The milling process can then be reinitiated by rotation accompanied by lowering of the pipe string so that the procedure continues. The sleeve 46 is forced upwardly by the spring 48 to lock the cutters in the extended position as exemplified at FIG. 5. Fluid flow continues upwardly away from both sets of cutters. That is the fluid flow washes around the cutters 30 during use and thereafter washes around the cutters 45 during use. The miller 40 is lowered to complete the milling cut which involves the process just described. In the example given, if it is necessary to mill 20 feet of the casing, the second cutters 45 can be used to complete the cut. By appropriate observations and measurements at the well head, the length of the cut can be easily determined by measuring the pipe string extended into the well during the cutting operation.

The foregoing process utilizes first and second (or additional) cutters on a common miller. It is possible by repeating and arrangement for the second cutter to install additional sets of cutters on the miller. In that instance, they can be located below the second cutters and are supported for movement radially outwardly in the same fashion as before.

In FIG. 7 of the drawings, a release system is shown for the miller 10 or 40. Briefly, the miller 10 ends in a conventional pin end 60 at the top of the sub 11. An internally located sleeve 61 is slidably mounted in the sub 11 and is provided with O-ring seals 62. A port 63 to the exterior is shielded by the sleeve 61 in the raised or up position. The sleeve is pinned in place by a shear pin 64 perpendicular to the plane of FIG. 7. The sleeve has an upper constricted shoulder 65 sized to receive a ball (not shown) dropped down the pipe string. The sphere plugs the miller 10 so that raised pump pressure will shear the pin 64 and force the ball and sleeve 61 downwardly. When this occurs, the member 17 is forced downwardly, moving the mandrel 16 lower and away from the cutters 30. As the miller 10 is raised in FIG. 1, the cutters 30 (worn from use) are forced radially inwardly; since the enlargement 20 is lowered (see FIG. 1 position), the cutters can fully retract. When the sleeve is forced downwardly, the pipe string is drained through the port 64 to avoid pulling a wet string.

While the foregoing is directed to alternate preferred embodiment, the scope thereof is determined by the claims which follow.

What is claimed is:

1. A miller for lowering into a cased well for milling a casing from the well, the miller comprising:

(a) an elongate outer tubular body having an inner axial passage therealong and adapted to be connected at the upper end thereof to a pipe string in the casing for rotation and lowering into the casing;

(b) a movable inner mandrel within said outer body, said inner mandrel movable between an initial position in said outer body and an operative position relative to the initial position therein;

(c) first cutters movably mounted on and supported by said outer body and having outwardly facing cutting edges for contact against surrounding casing wherein said cutters are constructed with cutting surfaces for cutting the casing on rotation of said outer body;

(d) first shoulder means movable with said inner mandrel for operatively moving said first cutters radially outwardly into a cutting position;

(e) second cutters movably mounted on and supported by said outer body and having outwardly facing cutting edges for contact against surrounding casing wherein said second cutters are constructed with cutting surfaces for cutting the casing on rotation of said outer body;

(f) second shoulder means movable with said inner mandrel for operatively moving said second cutters, said second shoulder means causing said second cutters to move radially outwardly into a cutting position;

(g) telescoping means cooperating with said inner mandrel for moving said first shoulder means, thereby actuating said first cutters, and simultaneously positioning said second shoulder means for operation of said second cutters prior to moving said second cutters outwardly into a cutting position, said telescoping means slidably positioning said second shoulder means for sliding movement relative to said body.

2. The apparatus of claim 1 including resilient means for applying a force between said inner mandrel and said outer body urging said inner mandrel towards the initial position thereof within said outer body.

3. The apparatus of claim 2 including windows in said outer body permitting said first and second cutters to extend therethrough radially outwardly into cutting position in contact with the casing to be cut.

4. The apparatus of claim 1 wherein said second shoulder means comprises a movable shoulder slidably mounted on said mandrel, lengthwise grooved on said shoulder, and including groove engaging arms mounting said cutters for deflection.

5. The apparatus of claim 4 wherein said inner mandrel serially mounts said first and second shoulders means thereon, said first shoulder means being operatively associated with said first cutters and said second shoulder being operatively associated with said second cutters.

6. The apparatus of claim 5 wherein said inner mandrel comprises an elongate member within said outer body movable therealong between the described positions, and said inner mandrel further includes first and second external shoulders abutting against first and second coil springs.

7. The apparatus of claim 6 wherein said inner mandrel is axially hollow with a passage therethrough permitting drilling fluid to flow therethrough to a point below said second cutters.

8. The apparatus of claim 7 wherein said first or second cutters include:

(a) a fixed pivot point supported by said outer body;

(b) a rotatable arm connected to said pivot point and rotatable between an inwardly retracted position and an outwardly extending cutting position; and (c) a cutter having a cutting edge thereon supported by said arm and said edge is on a radial line from the center thereof.

9. The apparatus of claim 1 including passages through said outer body and inner mandrel, said passages in the initial position limiting fluid flow therethrough and further wherein said passages move to alignment for fluid flow therethrough in the operative position so that drilling fluid delivered through the pipe string flows through said passages to thereby be introduced into the annular space around said cutter body to flow upwardly past said outer body and to wash said cutters to remove cuttings therefrom.

10. The apparatus of claim 9 further including a constricted outlet at the lower end of said outer body wherein the size of the constriction in conjunction with the aggregate cross-sectional area of said passages permits fluid to hydraulically move said inner mandrel and causes fluid to flow through said passages.

11. The apparatus of claim 1 wherein said second shoulder means comprises a tapered shoulder on a sleeve around said mandrel and within said body for movement relative both to said body and said mandrel.

12. The apparatus of claim 1 wherein said second shoulder means comprises a movable shoulder slidably mounted on said mandrel, lengthwise grooved on said shoulder, and including grooved engaging arms mounting said cutters for deflection.

13. The apparatus of claim 4 wherein said inner mandrel serially mounts said first and second shoulder means thereon, said first shoulder means being operatively associated with said first cutters and said second shoulder being operatively associated with said second cutters.

* * * * *